US007854326B1

(12) United States Patent
Beckett

(10) Patent No.: US 7,854,326 B1
(45) Date of Patent: Dec. 21, 2010

(54) MEDICINE STORAGE APPARATUS

(76) Inventor: Selena J. Beckett, 5807 NW. 268 Ter., Newberry, FL (US) 32669

( * ) Notice: Subject to any disclaimer, the term of this patent is extended or adjusted under 35 U.S.C. 154(b) by 116 days.

(21) Appl. No.: 12/397,011

(22) Filed: Mar. 3, 2009

(51) Int. Cl.
*B65D 83/04* (2006.01)

(52) U.S. Cl. ..... 206/534; 206/538; 206/540

(58) Field of Classification Search ..... 206/528, 206/530, 534, 535, 538–540, 459.1; 211/70; 221/2–4, 6, 9, 10, 15, 90, 113, 121, 277
See application file for complete search history.

(56) References Cited

U.S. PATENT DOCUMENTS

| | | | | |
|---|---|---|---|---|
| 3,334,731 | A * | 8/1967 | Dale | 206/534 |
| 4,334,617 | A * | 6/1982 | Rossmo | 206/534 |
| 4,473,156 | A | 9/1984 | Martin | |
| 4,725,999 | A | 2/1988 | Tate | |
| 5,152,422 | A | 10/1992 | Springer | |
| D393,203 | S | 4/1998 | Saltzman et al. | |
| 5,752,621 | A | 5/1998 | Passamante | |
| 5,782,359 | A * | 7/1998 | McAllister et al. | 206/538 |
| 5,921,395 | A * | 7/1999 | Alexander | 206/538 |
| 6,169,707 | B1 | 1/2001 | Newland | |
| 7,128,213 | B2 * | 10/2006 | Tung et al. | 206/538 |
| 2005/0205458 | A1 * | 9/2005 | Pearson | 206/538 |
| 2006/0163267 | A1 * | 7/2006 | Lapsker | 221/2 |
| 2007/0138048 | A1 * | 6/2007 | Coe et al. | 206/528 |

* cited by examiner

*Primary Examiner*—Luan K Bui
(74) *Attorney, Agent, or Firm*—Crossley Patent Law; Mark A. Crossley

(57) ABSTRACT

The medicine storage apparatus provides portable medication storage, identification, and dispensing. Each pie-shaped module is removable from the circular bottom of the revolving member. A domed handle provides easy carry capability. As each module is removable, a user can optionally take each module to a professional for filling with medication. Medications are placed in color-differentiated modules. Each module timer is set as needed. A user can thereby be notified by an alarm when medication time has arrived. Further, the various module colors can indicate the number of times daily a medication is needed. The lid of each module substantially comprises the module top, providing easy access while not encouraging spillage. And, the indicia panel of each module provides sufficient space for labeling, instructions, and other needed information, including Braille indicia.

17 Claims, 4 Drawing Sheets

MEDICINE STORAGE APPARATUS

BACKGROUND OF THE INVENTION

Medication organization and storage is long known to be fraught with problems. Not only have innumerable devices been proposed to alleviate some of these problems, further solution pursuits reflect the difficulties present in scheduling medicine intake. While not limited to older individuals, the problems are often magnified by same. Poor eyesight, arthritis, identification, and convenience are but a few of the issues many face.

FIELD OF THE INVENTION

The medicine storage apparatus relates to medicine storage devices and more especially to a portable medicine storage apparatus that provides revolving access to a plurality of removable modules, each with a timer with alarm and each available in different colors.

SUMMARY OF THE INVENTION

The general purpose of the medicine storage apparatus, described subsequently in greater detail, is to provide a medicine storage apparatus which has many novel features that result in an improved medicine storage apparatus which is not anticipated, rendered obvious, suggested, or even implied by prior art, either alone or in combination thereof.

To attain this, the medicine storage apparatus provides a portable means for medication storage, identification, and dispensing. Each pie-shaped module is removable from the circular bottom of the revolving member. The revolving member is disposed atop the circular base. A domed handle provides easy carry capability. As each module is removable, a user can optionally take each module to a professional for filling with medication, for example. Medications are placed in color-differentiated modules. Each timer is set as needed. A user can be notified by an alarm when medication time has arrived. As an example of use, the red module can be used for medications taken once per day. Perhaps the green module is used to store medications taken twice each day, and so on. Further, the lid of each module substantially comprises the module top, providing easy access while not encouraging spillage. An optional transparent lid provides greater medicine visibility. And, the indicia panel of each module provides sufficient space for labeling, instructions, and other needed information, including Braille indicia. The apparatus avoids the use of complex electronics, especially because many age groups either do not wish to or cannot operate such devices.

Thus has been broadly outlined the more important features of the improved medicine storage apparatus so that the detailed description thereof that follows may be better understood and in order that the present contribution to the art may be better appreciated.

An object of the medicine storage apparatus is to store numerous medications in an easily individually visible array.

Another object of the medicine storage apparatus is to store numerous medications in easily accessed individual containers.

A further object of the medicine storage apparatus is to provide ready identification of medications.

An added object of the medicine storage apparatus is to provide removability of each storage module.

And, an object of the medicine storage apparatus is to assist in scheduling medication intake.

Yet another object of the medicine storage apparatus is to be easily portable.

Still another object of the medicine storage apparatus is to store numerous medications in a space-efficient package.

Another object of the medicine storage apparatus is to make each medication readily available to a stationary user without lifting the apparatus.

And, an object of the medicine storage apparatus is to provide an easily used timer with alarm.

A further object of the medicine storage apparatus is to negate the use of complex electronics.

These together with additional objects, features and advantages of the improved medicine storage apparatus will be readily apparent to those of ordinary skill in the art upon reading the following detailed description of presently preferred, but nonetheless illustrative, embodiments of the improved medicine storage apparatus when taken in conjunction with the accompanying drawings.

In this respect, before explaining the current embodiments of the improved medicine storage apparatus in detail, it is to be understood that the medicine storage apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved medicine storage apparatus. It is therefore important that the claims be regarded as including such equivalent constructions insofar as they do not depart from the spirit and scope of the medicine storage apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 4 thereof, the principles and concepts of the medicine storage apparatus generally designated by the reference number 10 will be described.

Figure 1:
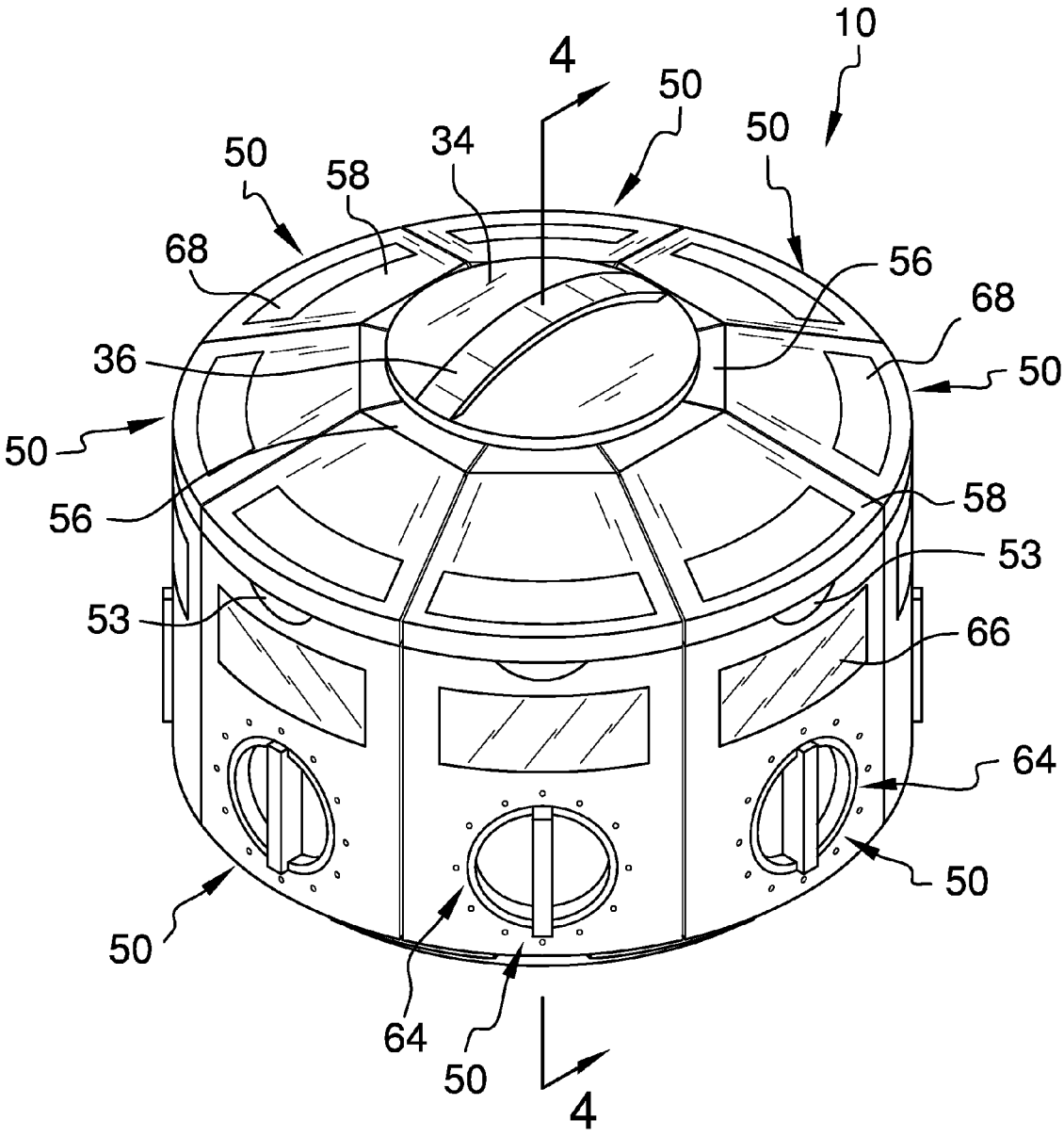
FIG. 1 is a perspective view.
Figure 2:
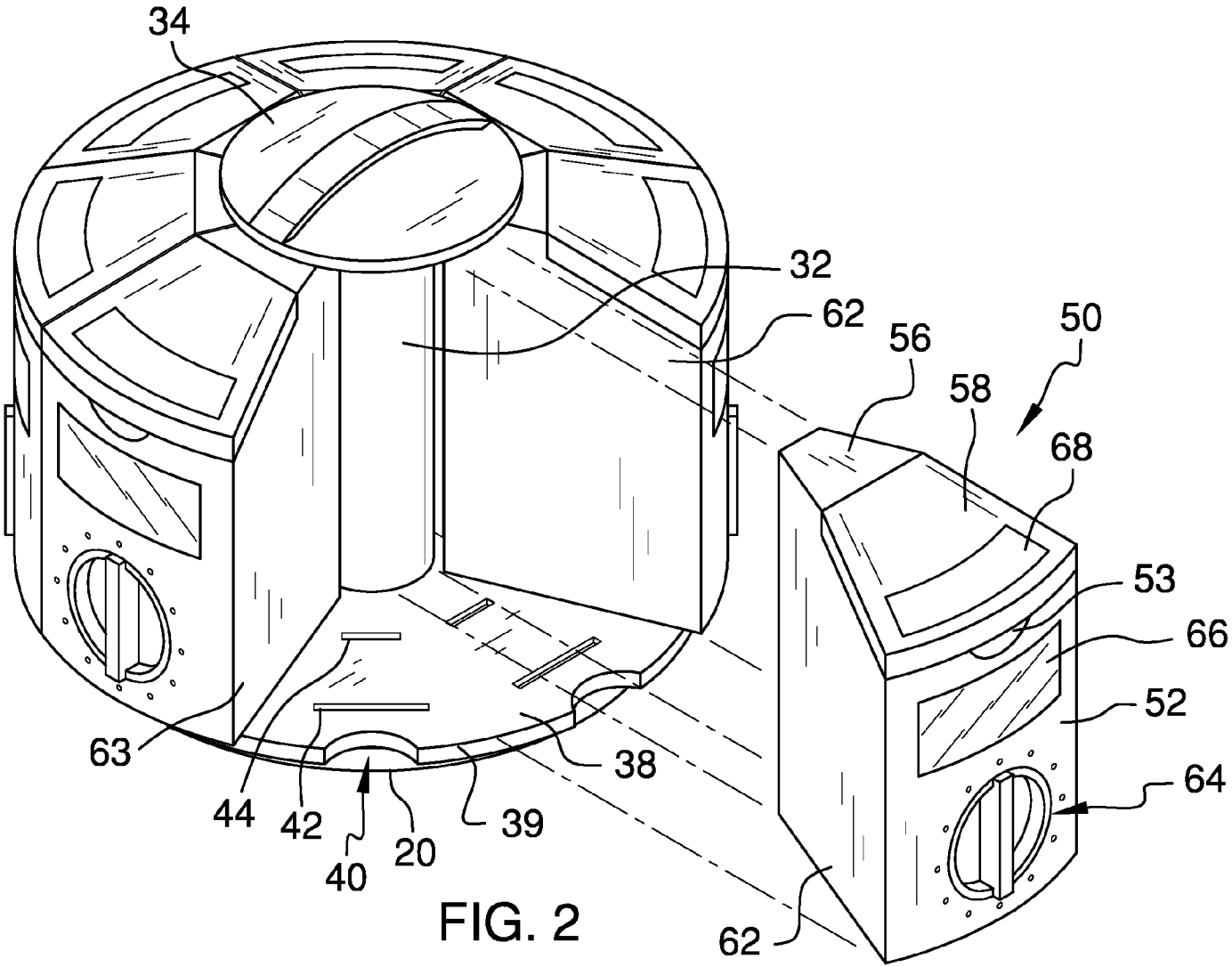
FIG. 2 is a perspective view, two modules removed.
Figure 4:
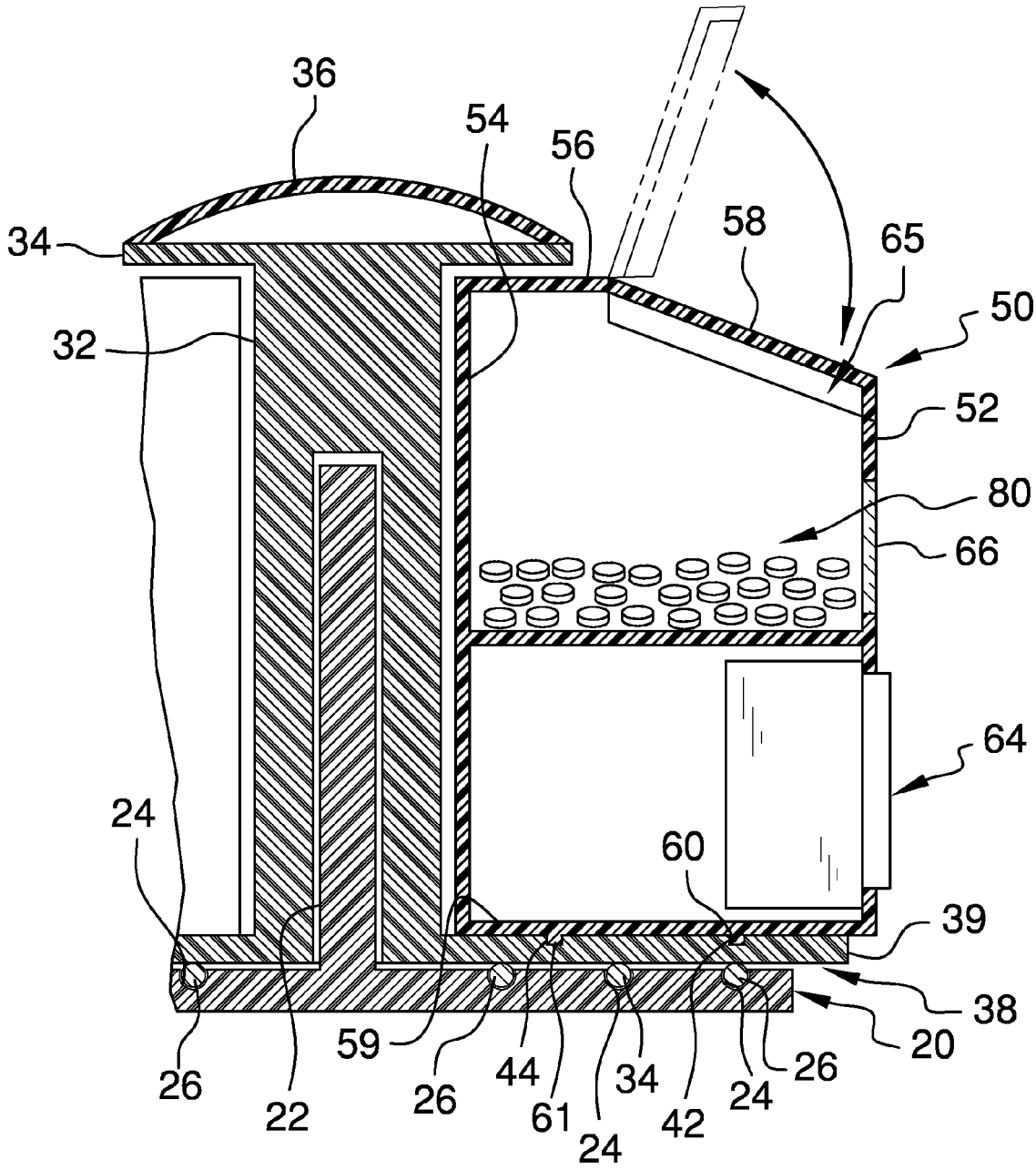
FIG. 4 is a partial cross sectional view of FIG. 1, taken along the line 4-4.

Referring to FIGS. 1, 2 and 4, the apparatus 10 provides for medication 80 storage and ready access. Each sector module 50 is removable from the circular bottom 38 of the revolving member 30. The apparatus 10 partially comprises a circular base 20. The center stalk 22 is extended upwardly from the circular base 20. A plurality of bearing pockets 24 is evenly distributed within the circular base 20. A bearing 26 is disposed within each pocket 24.

Figure 3:
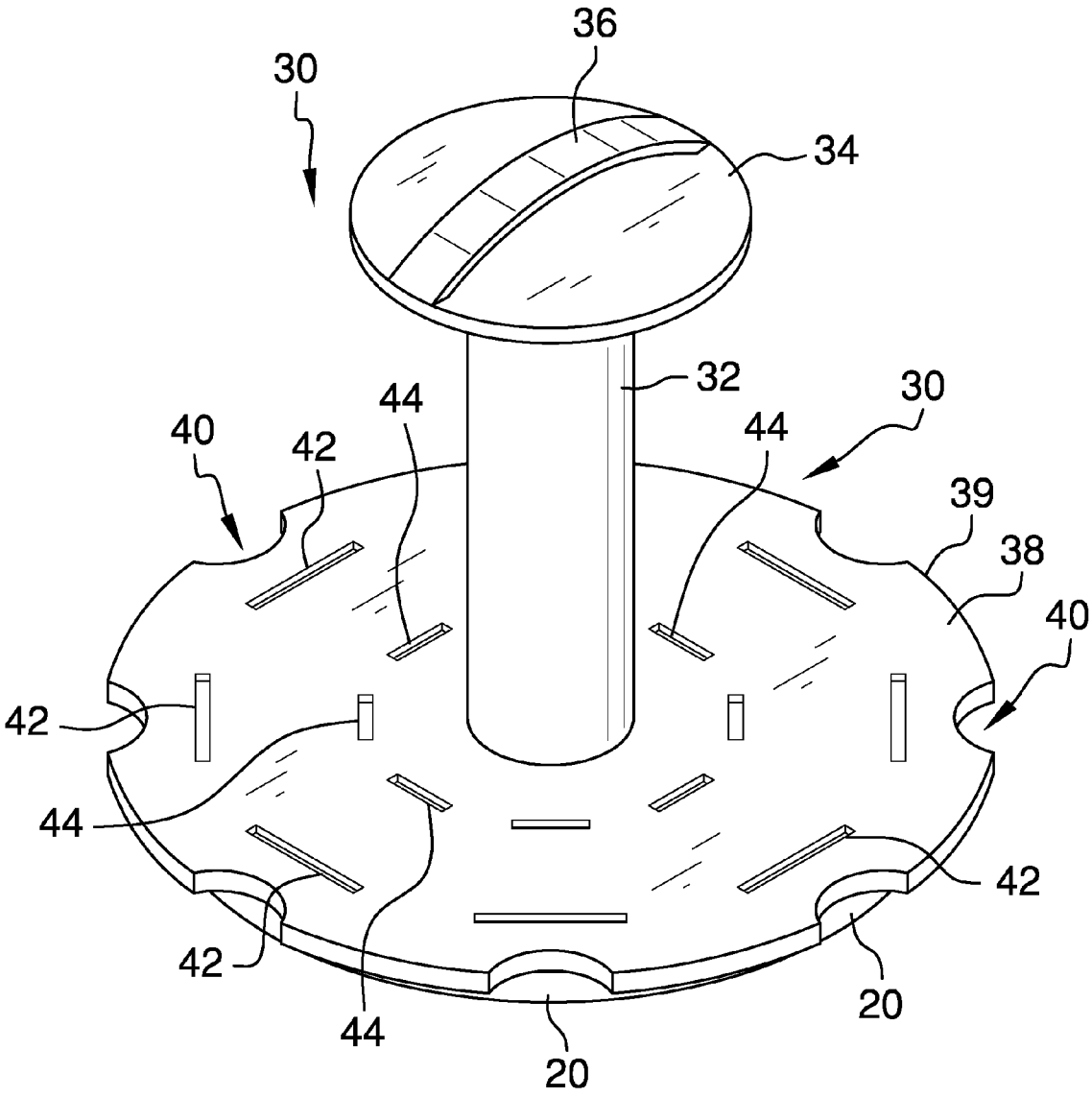
FIG. 3 is a perspective view of the circular base and revolving member.

Continuing to refer to FIGS. 1, 2, and 4, and referring also to FIG. 3, the revolving member 30 is disposed atop the circular base 20. The revolving member 30 partially comprises a circular bottom 38. The center cylinder 32 is atop the circular bottom 38. The center cylinder 32 is fitted over the circular base 20 center stalk 22. The circular bottom 38 rotatably rests upon the circular base 20 bearings 26. The circular cap 34 is disposed atop the center cylinder 32. The circular cap 34 has a diameter larger than a diameter of the center cylinder 32. The domed handle 36 is disposed atop the circular cap 34. A plurality of evenly spaced apart inner slots 44 is disposed within the circular bottom 38. The inner slots 44 are proximal to the center cylinder 32. A plurality of evenly spaced apart outer slots 42 is laterally disposed within the circular bottom 38. One outer slot 42 corresponds with each inner slot 44. A plurality of semicircular indentions 40 is evenly spaced apart in a perimeter 39 of the circular bottom 38. One indention 40 corresponds with each outer slot 42.

Referring again to FIGS. 2 and 4, the plurality of sector modules 50 is removably disposed atop the revolving member 30 circular bottom 38. One module 50 corresponds to one of each semicircular indention 40. Each module 50 resembles a pie slice. Each semicircular indention 40 provides for easiest module 50 removal from the circular bottom 38. Each module 50 comprises an arced front 52 spaced apart from a rear 54. Each module 50 further comprises a first side 62 spaced apart from a second side 63. A medially disposed flat inner top 56 hingedly connects to a downwardly sloped lid 58 on each module 50. The top 56 and the lid 58 are spaced apart from the bottom 59. The first insert 60 is disposed on the bottom 59. The first insert 60 removably corresponds with one outer slot 42 of the circular bottom 38. A second insert 61 is disposed on the bottom 59 of each module 50. The second insert 61 removably corresponds with one inner slot 44 of the circular bottom 38. The inserts removably locate each module 50 within the circular bottom 38. An indicia panel 68 is disposed laterally atop each lid 58. A front indent 53 is disposed within the front 52 of each module 50 and provides for easy lid 58 lift. The front indent 53 is adjacent to the lid 58. A window 66 is disposed within each front 52. The window 66 is proximal to the front indent 53. A dial timer 64 is disposed within the front 52 below the window 66 and includes alarm capability. An upper compartment 65 is disposed above the timer 64 and below the lid 58 in each module 50.

Referring again to FIGS. 1 and 2, each indicia panel 68 of each module 50 is optionally provided with more than one form of indicia. For example, one embodiment provides Braille indicia. Another embodiment provides a stick-on label (not shown) for printed indicia. Additionally, each module 50 is optionally provided in a different color from other modules 50. Colors provide further module and therefore medication differentiation and recognition.

With respect to the above description then, it is to be realized that the optimum dimensional relationships for the parts of the medicine storage apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the medicine storage apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the medicine storage apparatus may be used.

Therefore, the foregoing is considered as illustrative only of the principles of the medicine storage apparatus. Further, since numerous modifications and changes will readily occur to those skilled in the art, it is not desired to limit the medicine storage apparatus to the exact construction and operation shown and described, and accordingly, all suitable modifications and equivalents may be resorted to, falling within the scope of the medicine storage apparatus.

What is claimed is:

1. A medicine storage apparatus, comprising, in combination:

a circular base;

a revolving member disposed atop the circular base, the revolving member comprising:

a circular bottom;

a center cylinder atop the circular bottom, the circular bottom rotatably rested upon bearings of the circular base;

a circular cap atop the center cylinder, the circular cap having a diameter larger than a diameter of the center cylinder;

a domed handle atop the circular cap;

a plurality of evenly spaced apart inner slots disposed within the circular bottom, the inner slots proximal to the center cylinder;

a plurality of evenly spaced apart outer slots laterally disposed within the circular bottom, an outer slot corresponding with each inner slot;

a plurality of semicircular indentions evenly spaced apart in a perimeter of the circular bottom, a one indention corresponding with each outer slot;

a plurality of sector modules removably disposed atop the circular bottom of the revolving member, a one module for one of each semicircular indention, each module resembling a pie slice, each module comprising:

an arced front spaced apart from a rear;

a first side spaced apart from a second side;

a medially disposed flat inner top hingedly connected to a downwardly sloped lid, the top and lid spaced apart from a bottom;

a first insert disposed on the bottom, the first insert removably corresponding with one outer slot of the circular bottom;

a second insert disposed on the bottom, the second insert removably corresponding with one inner slot of the circular bottom, the inserts removably locating the module within the circular bottom;

an indicia panel disposed laterally atop the lid;

a front indent within the front, the front indent adjacent to the lid;

a window within the front, the window proximal to the front indent;

a timer disposed within the front below the window;

an upper compartment disposed above the timer and below the lid.

2. The apparatus according to claim 1 wherein each module further comprises a different color.

3. The apparatus according to claim 1 wherein the timer further comprises a dial timer.

4. The apparatus according to claim 2 wherein the timer further comprises a dial timer.

5. The apparatus according to claim 1 wherein the timer further comprises an alarm.

6. The apparatus according to claim 2 wherein the timer further comprises an alarm.

7. The apparatus according to claim 3 wherein the timer further comprises an alarm.

8. The apparatus according to claim 4 wherein the timer further comprises an alarm.

9. The apparatus according to claim 1 wherein the sloped lid further comprises a transparent lid.

10. The apparatus according to claim 2 wherein the sloped lid further comprises a transparent lid.

11. The apparatus according to claim 3 wherein the sloped lid further comprises a transparent lid.

12. The apparatus according to claim 4 wherein the sloped lid further comprises a transparent lid.

13. The apparatus according to claim 5 wherein the sloped lid further comprises a transparent lid.

14. The apparatus according to claim 6 wherein the sloped lid further comprises a transparent lid.

15. The apparatus according to claim 7 wherein the sloped lid further comprises a transparent lid.

16. The apparatus according to claim 8 wherein the sloped lid further comprises a transparent lid.

17. A medicine storage apparatus, comprising, in combination:

a circular base;

a center stalk extended upwardly from the circular base;

a plurality of bearing pockets evenly distributed within the circular base;

a bearing disposed within each pocket;

a revolving member disposed atop the circular base, the revolving member comprising:

a circular bottom;

a center cylinder atop the circular bottom, the center cylinder fitted over the center stalk, the circular bottom rotatably rested upon the bearings of the circular base;

a circular cap atop the center cylinder, the circular cap having a diameter larger than a diameter of the center cylinder;

a domed handle atop the circular cap;

a plurality of evenly spaced apart inner slots disposed within the circular bottom, the inner slots proximal to the center cylinder;

a plurality of evenly spaced apart outer slots laterally disposed within the circular bottom, an outer slot corresponding with each inner slot;

a plurality of semicircular indentions evenly spaced apart in a perimeter of the circular bottom, a one indention corresponding with each outer slot;

a plurality of sector modules removably disposed atop the circular bottom of the revolving member, a one module for one of each semicircular indention, each module resembling a pie slice, each module comprising:

an arced front spaced apart from a rear;

a first side spaced apart from a second side;

a medially disposed flat inner top hingedly connected to a downwardly sloped lid, the top and lid spaced apart from a bottom;

a first insert disposed on the bottom, the first insert removably corresponding with one outer slot of the circular bottom;

a second insert disposed on the bottom, the second insert removably corresponding with one inner slot of the circular bottom, the inserts removably locating the module within the circular bottom;

an indicia panel disposed laterally atop the lid;

a front indent within the front, the front indent adjacent to the lid;

a window within the front, the window proximal to the front indent;

a dial timer disposed within the front below the window;

an upper compartment disposed above the timer and below the lid.

* * * * *